United States Patent [19]

Fukazawa et al.

[11] Patent Number: 4,676,714

[45] Date of Patent: Jun. 30, 1987

[54] REVERSIBLE CENTRIFUGAL PUMP

[75] Inventors: Tetsuo Fukazawa, Tokyo; Shigeyoshi Yokoyama, Sakura, both of Japan

[73] Assignees: Nihon Radiator Co., Ltd.; Pacific Machinery & Engineering Co., Ltd., both of Tokyo, Japan

[21] Appl. No.: 815,365

[22] Filed: Dec. 31, 1985

[30] Foreign Application Priority Data

Jan. 11, 1985 [JP] Japan ..... 60-2123

[51] Int. Cl.[4] ..... F04D 3/02; F04D 17/02

[52] U.S. Cl. ..... 415/72; 415/203; 415/219 C

[58] Field of Search ..... 415/72, 120, 152 R, 415/152 A, 154, 203, 204, 205, 219 R, 219 C; 416/176, 177, 208

[56] References Cited

U.S. PATENT DOCUMENTS

| | | | |
|---|---|---|---|
| 1,058,790 | 4/1913 | Pierce | 415/72 |
| 1,182,571 | 5/1916 | Kirsch | 415/72 |
| 3,589,149 | 6/1971 | Fischer | 416/208 X |
| 3,773,432 | 11/1973 | Chow et al. | 415/152 A |

FOREIGN PATENT DOCUMENTS

| | | | |
|---|---|---|---|
| 901500 | 7/1945 | France | 415/203 |
| 593633 | 5/1959 | Italy | 415/152 A |
| 693686 | 7/1953 | United Kingdom | 415/181 |

*Primary Examiner*—Robert E. Garrett
*Assistant Examiner*—Joseph M. Pitko
*Attorney, Agent, or Firm*—Kane, Dalsimer, Kane, Sullivan and Kurucz

[57] ABSTRACT

A centrifugal pump capable of rotating in a normal direction while enabling a fluid to flow in a normal direction and rotating in a reverse direction while enabling the fluid to flow in the reverse direction without having its pumping efficiency dropping to a lower level in a reverse rotation mode than in a normal rotation mode. The pump includes two pump casings each having an inlet and outlet portion extending tangentially of each pump casing and connected together through an intermediate casing to provide a unitary structure in which the two pump casings are located concentrically in face-to-face relation, and an impeller having a helical blade extending axially from one zone in one pump casing into another zone in the other pump casing for rotation along the center axis of the pump. The impeller has a minimum outer diameter at the center of its center axis and includes portions each flaring in one of axial opposite directions in the form of a cone. The impeller has an outer periphery cooperating with an inner periphery of the intermediate casing to define a small clearance therebetween. The inlet and outlet portions of the two pump casings are arranged such that when the two pump casings alternately act as a suction casing at the time of normal rotation and reverse rotation, the influx direction of the fluid through the inlet and outlet portion of the pump casing acting as a suction casing is opposed to the direction of rotation of the impeller means.

2 Claims, 14 Drawing Figures

Suction Casing

Discharge Casing

Discharge Casing

Suction Casing

REVERSIBLE CENTRIFUGAL PUMP

BACKGROUND OF THE INVENTION

This invention relates to centrifugal pumps, and more particularly it is concerned with a centrifugal pump of the type which is capable of rotating in a normal direction while enabling a fluid to flow in the normal direction and rotating in a reverse direction while enabling the fluid to flow in the reverse direction.

Generally, when a centrifugal pump is let to rotate in the reverse direction, the fluid handled flows in the normal direction and the performance of the pump is greatly reduced. Thus, in centrifugal pumps of the prior art, no flow of fluid takes place in the reverse direction when the pump is rotating in the reverse direction.

SUMMARY OF THE INVENTION

This invention has as its object the provision of a novel centrifugal pump in which an impeller having a helical blade is used to eliminate the aforesaid characteristic of the centrifugal pump of the prior art obtained when the pump rotates in the reverse direction, whereby the centrifugal pump can rotate in the normal direction while enabling a fluid to flow in the normal direction and rotate in the reverse direction while enabling the fluid to flow in the reverse direction without having pumping efficiency dropping to a lower level in a reverse rotation mode than in a normal rotation mode.

To accomplish the aforesaid object, the invention provides a centrifugal pump capable of rotating in a normal direction while enabling a fluid to flow in the normal direction and rotating in a reverse direction while enabling the fluid to flow in the reverse direction, comprising pump casing means including a first pump casing member and a second pump casing member each having an inlet and outlet portion entending tangentially of an outer periphery of each pump casing member, and an intermediate casing member interposed between the first pump casing member and second pump casing member and coupled thereto to provide a unitary structure in which the two pump casing members are located concentrically in faceto-face relation, and impeller means including a helical blade member extending axially from one zone in the first pump casing member into another zone in the second pump casing member for rotation along the center axis of the pump, said impeller means having a minimum outer diameter at the center of its center axis and including portions each flaring in one of axial opposite directions in the form of a cone, said impeller means having an outer periphery cooperating with an inner periphery of said intermediate casing member to define a small clearance therebetween, said inlet and outlet portions of said two pump casing members being arranged such that when said two pump casing members alternately act as a suction casing at the time of normal direction and reverse direction of the impeller, the influx direction of the fluid through the inlet and outlet portion of the pump casing acting as a suction casing is opposed to the direction of rotation of the impeller.

DESCRIPTION OF THE PREFERRED EMBODIMENT

Figure 1:
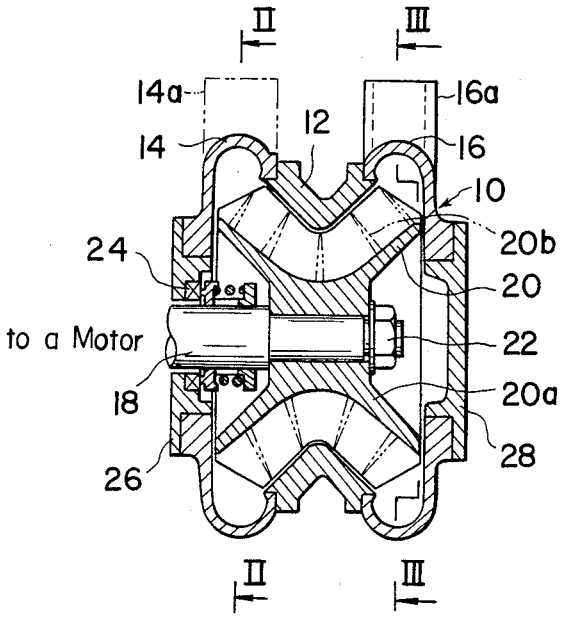
FIG. 1 is a vertical sectional view of the centrifugal pump comprising one embodiment of the invention, which is capable of rotating in a normal direction while enabling a fluid to flow in the normal direction and rotating in a reverse direction while enabling the fluid to flow in the reverse direction.
Figure 2:
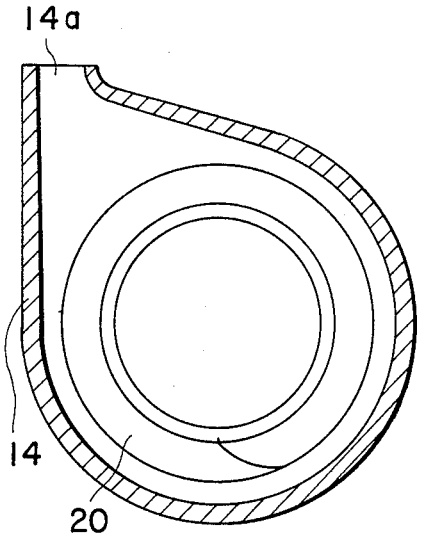
FIG. 2 is a transverse sectional view taken along the line II—II in FIG. 1.
Figure 3:
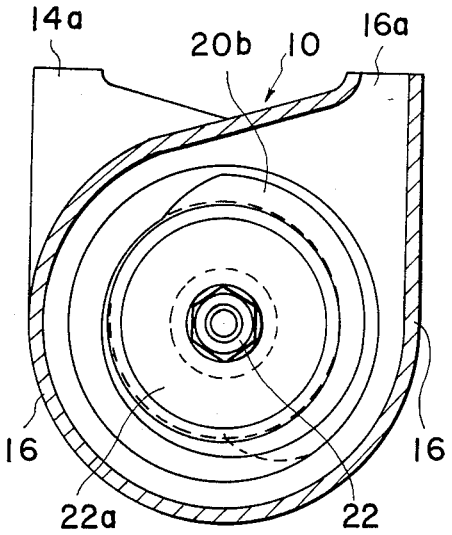
FIG. 3 is a transverse sectional view taken along the line III—III in FIG. 1.

FIG. 1 shows in a vertical sectional view as seen in an axial direction of a centrifugal pump 10 comprising one embodiment of the invention which is capable of rotating in a normal direction while enabling a fluid to flow in the normal direction and rotating in a reverse direction while enabling the fluid to flow in the reverse direction. The centrifugal pump 10 comprises a first pump casing member 14 and a second pump casing member 16 locate concentrically in face-to-face relation and bolted together through an intermediate casing member 12. As can be clearly seen in FIGS. 2 and 3, the first pump casing member 14 and second pump casing member 16 may be each circular in cross section or a volute casing of ordinary centrifugal pumps. As can be clearly seen in FIG. 3, the two pump casings 14 and 16 have nozzles or inlet and outlet portions **14*a* and 16*a* respectively which are located parallel to each other and extend tangentially from opposite sides of the outer peripheries of the two pump casing members 14 and 16 disposed on opposite ends of the pump 10 and facing each other. A shaft 18 connected to a motor extends through the two pump casing members 14 and 16 along their center axis and has an impeller 20 secured thereto by a nut 22. The shaft 18 may be a motor shaft. The impeller 20 includes a boss 20a having portions each flaring in one of axially opposite directions in the form of a cone, and a helical blade member 20b located on the peripheral surface of the boss 20a and extending axially from one zone in the first pump casing member 14 into another zone in the second pump casing member 16. Thus, the impeller 20 is configured such that its outer diameter is minimized at its central portion and successively increases in going from its central portion in opposite axial directions in the form of a cone. The intermediate casing member 12 has an inner periphery which extends along and cooperates with an outer periphery of the helical blade 20***b* of the impeller 20 to define therebetween a small clearance. In the embodiment shown and described, the impeller 20 is formed as a unitary structure. Thus, to facilitate assembling, the intermediate casing member 12 is split into two halves along a horizontal plane including its axis, and they are bolted together. The reference numeral 24 designates a mechanical seal. A first pump casing cover 26 is bolted to the first pump casing member 14, and a second pump casing cover 28 is bolted to the second pump casing member 16.

In the embodiment shown and described, the impeller 20 is formed as a unitary structure. However, this is not restrictive, and the impeller 20 may be split at its center in a plane perpendicular to its axis into two half impeller portions each having a conical shape which may be connected together at the center of the impeller 20. When the impeller 20 is formed in this way, the pump casing members 14 and 16 may be formed as one-piece structure with the intermediate casing member 12. However, when the pump casing members 14 and 16 are formed as one-piece structure, the structures formed at the outer peripheries on opposite axial ends of the pump casing members for the casing covers to be fitted therein should have a diameter which is slightly larger than the maximum outer diameter of the impeller.

Operation of the centrifugal pump constructed as described hereinabove according to the invention will be described by referring to FIGS. 4–7.

Figure 4:
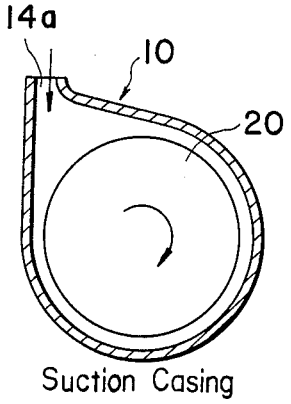
FIGS. 4 and 5 are transverse sectional views each showing one of the two pump casing members of the centrifugal pump shown in FIG. 1 in explanation of the relation between the suction casing and the discharge casing when the pump rotates in the normal direction.
Figure 5:
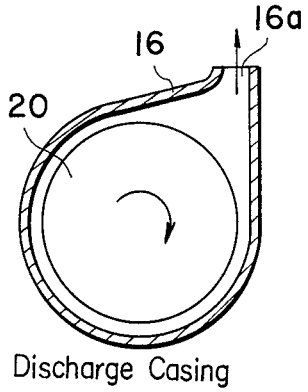
Figure 6:
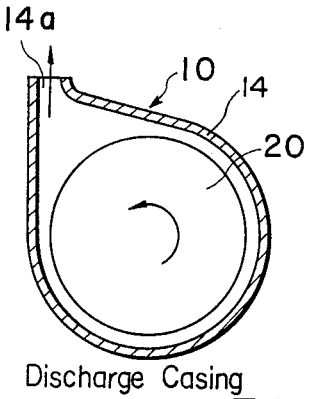
FIGS. 6 and 7 are views similar to FIGS. 4 and 5 respectively but showing the two pump casing members in explanation of the relation between the suction casing and the discharge casing when the pump rotates in the reverse direction.
Figure 7:
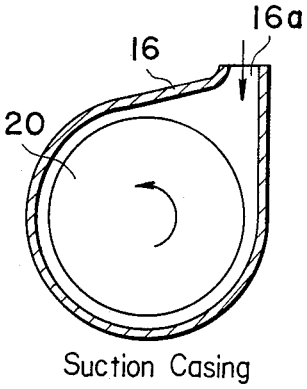
Figure 8:
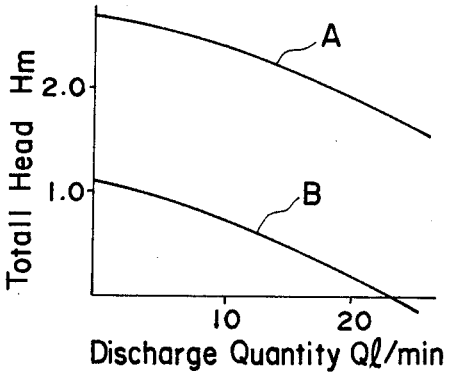
FIG. 8 is a diagrammatic representation of the total head curve regarding the centrifugal pump according to the invention and another centrifugal pump for comparison.

FIGS. 4 and 5 are schematic sectional views of the first pump casing member 14 and second casing member 16 respectively obtained when the central transverse cross sections of the two pump casing members are viewed from the same direction in a normal rotation mode, and FIGS. 6 and 7 are views similar to FIGS. 4 and 5 respectively but obtained in a reverse rotation mode. These figures show the relation between the suction casing and discharge casing of the pump to which the first pump casing member 14 and second pump casing member 16 alternately become as the impeller switches its direction of rotation from normal to reverse and vice versa. That is, when the impeller 20 rotates in the normal direction, the first pump casing member 14 becomes a suction casing as shown in FIG. 4 and the direction of flow of the fluid through the inlet and outlet portion 14*a* is opposed to the direction of rotation of the impeller 20 at the pump inlet. The second pump casing member 16 becomes a discharge casing, as shown in FIG. 5, and the fluid under pressure is discharged through the inlet and outlet portion 16*a*. When the direction of rotation of the impeller 20 is reversed, the second pump casing member 16 becomes a suction casing, as shown in FIG. 7, and the direction of flow of the fluid through the inlet and outlet portion 16*a* is opposed to the direction of rotation of the impeller 20. The first pump casing member 14 becomes a discharge casing, as shown in FIG. 6, and the fluid under pressure is discharged through the inlet and outlet portion 14*a*. In the centrifugal pump according to the invention, it is an important feature that, regardless of whether the pump is rotating in a normal direction or in a reverse direction, the direction of flow of a fluid at the inlet port or suction port of the suction casing is opposed to the direction of rotation of the impeller. Experiments conducted on the operation of the centrifugal pump according to the invention have produced results which show that the pump has the total head H represented by a curve A shown in FIG. 8, both in a normal rotation mode and in a reverse rotation mode.

Figure 9:
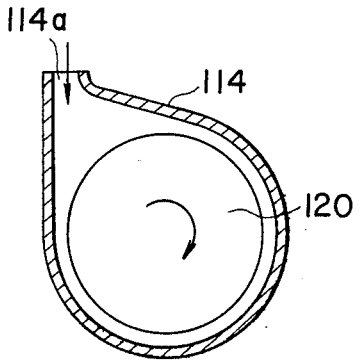
FIG. 9 PRIOR ART
FIGS. 9 and 10 are transverse sectional views each showing one of two pump casing members of a centrifugal pump of the prior art in explanation of the relation between the suction casing and the discharge casing when the pump rotates in the normal direction.
Figure 10:
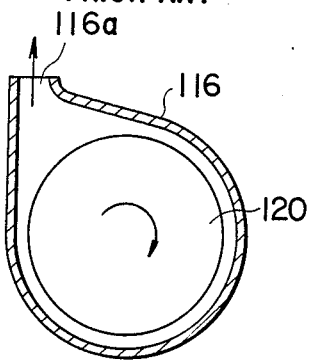
FIG. 10 PRIOR ART
Figure 11:
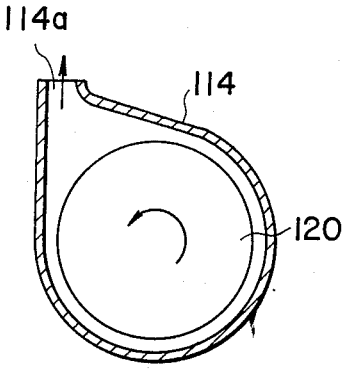
FIG. 11 PRIOR ART
FIGS. 11 and 12 are views similar to FIGS. 9 and 10 but showing the two pump casing members in explanation of the relation between the suction casing and the discharge casing when the pump rotates in the reverse direction.
Figure 12:
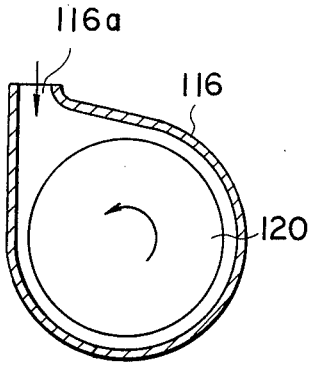
FIG. 12 PRIOR ART

A centrifugal pump having two inlet and outlet portions located on the same side of the two pump casing with respect to the axis of the pump will be described in comparison with the centrifugal pump according to the invention. FIGS. 9 and 10 show two pump casings 114 and 116 having inlet and outlet portions 114*a* and 116*a* respectively located on the same side, in which the pump casing 114 serves as a suction casing and the pump casing 116 as a discharge casing in a normal rotation mode. FIGS. 11 and 12 are similar to FIGS. 9 and 10 respectively but show the pump casings in a reverse rotation mode, in which the pump casing 114 serves as a discharge casing and the pump casing 116 as a suction casing. It will be seen that, in FIG. 9 in which the pump casing 114 serves as a suction casing, the direction of flow of a fluid through the inlet and outlet portion 114*a* is opposed to the direction of rotation of an impeller 120 at the pump inlet. In FIG. 10 in which the pump casing 116 serves as a discharge casing, the fluid under pressure is discharged through the inlet and outlet portion 116*a*. The results of experiments conducted on this type of centrifugal pump are as follows. When the pump rotated in the normal direction in which the direction of flow of the fluid through the inlet and outlet portion of the suction casing was opposed to the direction of rotation of the impeller at the pump inlet, the pump had the head curve similar to the curve A obtained in the experiments on the centrifugal pump 10 in which the inlet and outlet portions of the two pump casing members are located at sides opposed to each other with respect to the axis of the pump. When the direction of rotation of the impeller of the centrifugal pump having the arrangement of the pump casings shown in FIGS. 9, 10, 11 and 12 was reversed, the fluid flowed through the inlet and outlet portion 116*a* into the pump casing 116 serving as a suction casing as shown in FIG. 12 in the same direction as the rotation of the impeller 120 and the fluid was discharged through the inlet and outlet portion 114*a* of the pump casing 114 serving as a discharge casing as shown in FIG. 11. In the reverse rotation mode, the pump had the head represented by a curve B shown in FIG. 8 which was reduced as compared with the head represented by the curve A. This is because the fluid flows into the suction casing through the inlet and outlet portion thereof in the same direction as the direction of rotation of the impeller at the pump inlet.

The results of the experiments described hereinabove show that it is important that the inlet and outlet portions of the first pump casing member and the second pump casing member be located tangentially of the impeller in such a manner that when the two pump casing members alternately act as a suction casing at the time of normal rotation and reverse rotation of the impeller, the influx direction of the fluid through the inlet and outlet portion of the pump casing acting as a suction casing is opposed to the direction of rotation of the impeller. This arrangement of the inlet and outlet portions of the first and second pump casing members enables a centrifugal pump according to the invention to be obtained which is capable of rotating in a normal direction while enabling a fluid to flow in the normal direction and rotating in a reverse direction while enabling the fluid to flow in the reverse direction and which has the head of practical value both in the normal rotation mode and in the reverse rotation mode.

Figure 13:
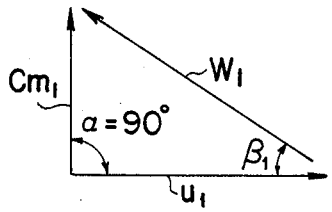
FIG. 13 shows a vector of velocities at the inlet port of a centrifugal pump of the prior art performing a normal pumping operation.
Figure 14:
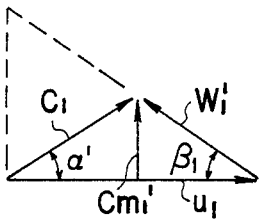
FIG. 14 shows a vector of velocities at the inlet of a centrifugal pump of the prior art obtained when a prerotation occurs in the vicinity of the inlet of the pump.

The reason why it is important to let the fluid flow into the pump through the inlet and outlet portion of the suction casing in a direction opposed to the direction of rotation of the impeller will be described by referring to FIGS. 13 and 14. FIG. 13 is a diagram showing a vector of velocities obtained at the inlet of a centrifugal pump when a normal operation is performed. In the diagram shown in FIG. 13, $U_1$, $W_1$, $C_{m1}$ $\alpha$ designate the inlet peripheral velocity of the impeller, the relative velocity of the fluid particles with respect to the impeller, meridional component of absolute velocity $C_1$ of the fluid particles, and the inlet angle of the fluid, respectively. It is $C_{m1}$ that decides the head of the pump. When a prerotation occurs in the vicinity of the pump inlet in this inlet velocity triangle, the inlet angle $\alpha$ changes to $\alpha'$ (see FIG. 14) and the meridional component of absolute velocity of the fluid particles $C_{m1}$ is reduced to $C_{m1'}$. As a result, the flow rate is greatly reduced.

When a centrifugal pump capable of rotating in a normal direction while enabling a fluid to flow in the normal direction and rotating in a reverse direction while enabling the fluid to flow in the reverse direction is designed by connecting two pump casings in face-toface relation, each pump casing is required to perform the functions of suction and discharge. However, in an ordinary centrifual pump, the position of inlet and outlet portion of each casing is designed with a view to improving the discharge performance of the pump. Thus, when each casing of this design functions as a suction casing, a prerotation of an extremely great magnitude is produced, resulting in a marked reduction in pumping efficiency. To avoid this trouble, one only has to design the pump casings in such a manner that the influx direction of the fluid flow through each of the inlet and outlet portions of the pump casing members alternately acting as a suction casing at the time of normal rotation and reverse rotation is opposed to the direction of rotation of the impeller, as stated above.

When provided with the aforesaid feature according to the invention, a centrifugal pump can be made to rotate in a normal direction while allowing a fluid to flow in the normal direction and to rotate in a reverse direction while enabling the fluid to flow in the reverse direction without having its pumping efficiency dropping to a lower level in a reverse rotation mode than in a normal rotation mode.

What is claimed is:

1. A centrifugal pump capable of rotating in a normal direction while enabling a fluid to flow in the normal direction and rotating in a reverse direction while enabling the fluid to flow in the reverse direction, comprising:

pump casing means including a first pump casing member and a second pump casing member each having an inlet and outlet portion extending tangentially of an outer periphery of each said pump casing member, and an intermediate casing member interposed between said first pump casing member and second pump casing member and coupled thereto to provide a unitary structure in which said first and second pump casing members are located concentrically in face-to-face relation; and impeller means including a helical blade member extending axially from one zone in the first pump casing member into another zone in the second pump casing member for rotation along the center axis of the pump, said impeller means having a minimum outer diameter at the center of its center axis and including portions each flaring in one of axial opposite directions in the form of a cone, said impeller means having an outer periphery cooperation with an inner periphery of said intermediate casing member to define a small clearance therebetween;

said inlet and outlet portions of said first and second pump casing members being arranged such that when said first and second pump casing members alternately act as a suction casing at the time of normal direction and reverse rotation of the impeller, the influx direction of the fluid through the inlet and outlet portion of the pump casing acting as a suction casing is opposed to the direction of rotation of the impeller.

2. A centrifugal pump as claimed in claim 1, wherein said impeller means includes two impeller means of cone shape formed integrally with each other as a unitary structure.

* * * * *